US005838278A

United States Patent [19]

Tsujisawa et al.

[11] Patent Number: 5,838,278

[45] Date of Patent: Nov. 17, 1998

[54] ANTENNA POINTING APPARATUS MOUNTED ON SATELLITE USING FEED FORWARD WITH REFERENCE MODEL

[75] Inventors: Takahiko Tsujisawa; Toshiaki Yamashita, both of Tokyo, Japan

[73] Assignee: NEC Corp., Japan

[21] Appl. No.: 735,882

[22] Filed: Oct. 23, 1996

[30] Foreign Application Priority Data

Oct. 25, 1995 [JP] Japan ..... 7-277335

[51] Int. Cl.[6] ..... H01Q 3/00

[52] U.S. Cl. ..... 342/377; 342/359

[58] Field of Search ..... 342/359, 375, 342/377

[56] References Cited

U.S. PATENT DOCUMENTS 4,839,573 6/1989 Wise ..... 318/615

5,062,592 11/1991 Kishimoto ..... 342/357 X

OTHER PUBLICATIONS

Leo, D.J., et al., "Pointing Control and Vibration Suppression of a Slewing Flexible Frame", Journal of Guidance Control and Dynamics, vol. 17, No. 3, May–Jun. 1994, pp. 529–536.

Awa, Y., et al., "Precise Antenna Pointing Control for Inter–Orbit Communication Satellite", Second International Conference on Motion and Vibration Control, Aug. 30 to Sep. 3, 1994, pp. 527–532.

*Primary Examiner*—Joseph L. Felber

*Attorney, Agent, or Firm*—Ostrolenk, Faber, Gerb & Soffen, LLP

[57] ABSTRACT

An optical antenna pointing controller for an optical antenna system having an optical antenna and biaxial gimbal mechanism coupled to the optical antenna and mounted on the satellite is provided. Feedback control in the controller is gain-stabilized by a nominal compensator, and disturbance is suppressed by a robust compensator, further, a target satellite is captured quickly with the aid of a reference model and feedforward, thus providing quick response without dependency on the band width of feedback control system.

10 Claims, 3 Drawing Sheets

ANTENNA POINTING APPARATUS MOUNTED ON SATELLITE USING FEED FORWARD WITH REFERENCE MODEL

BACKGROUND OF THE INVENTION

1. Field of the Invention

This invention relates to an optical antenna pointing controller for an antenna system mounted on a satellite for communication between satellites.

2. Description of the Related Art

Conventionally, attitude control for a satellite is performed by feedback control such as proportional and integral (PI) control, proportional and differential PD control, or proportional, integral and differential (PID) control, wherein a gain margin technique has been used to determine these parameters.

The gain margin technique has been used because the destabilization of a control system due to high order structural vibration mode of a support structure (generally referred to as spill over) is suppressed. Therefore, the band width of the feedback control system is prescribed to be inherently narrow.

However, in the case of pointing control of an optical antenna for interorbit communication, a moving satellite should be captured quickly and the accuracy of pointing for communication should be extremely high. To meet these requirements, a wide control band width is necessary in the stable range of gain, when the gain margin technique is used. Thus a disadvantage of the conventional pointing control system is that even, if the problem of structural vibration mode is resolved, another problem remains in that the effect of non-linear disturbances can not be suppressed. At worst, the effect of the disturbances can cause the control system to operate unstably.

OBJECT AND SUMMARY OF THE INVENTION

It is an object of the present invention to provide an optical antenna pointing controller for operating an optical antenna quickly without the above-mentioned problems and without setting a high control band width.

According to the present invention, an optical antenna pointing controller is provided for an optical antenna driving mechanism on a satellite-having an optical antenna, a biaxial gimbal mechanism coupled to the optical antenna and mounted on the satellite, a motor for driving the optical antenna, a motor driving amplifier for feeding a current to the motor, an encoder for measuring rotation angle of the optical antenna driven by the motor, the encoder being mounted on the opposite end from where the motor of the gimbal mechanism for linking the motor and the optical antenna is mounted, and an angle error processor for generating an output of the pointing angle error of the optical antenna from optical beam received by the optical antenna. The optical antenna pointing angle controller includes a first adder for calculating the pointing angle target value for the optical antenna using an output of the encoder and an output of the angle error processor as input, a reference model composed of two or more integral elements for receiving the output from the first adder to control the motion of the optical antenna, a subtracter for calculating the difference between the output of the encoder and output of the reference model, a nominal compensator for stabilizing a feedback control system of the optical antenna including the optical antenna, the subtracter, and the encoder by receiving the output from the subtracter, a robust compensator composed of a low-pass filter with gain of 1 at zero frequency in the second-order or higher, second-order differential elements, and gain for the compensation of external force and disturbance loaded on the optical antenna by receiving the output of the encoder and output of the motor driving amplifier, a feedforward element for reciprocally multiplying the gain at the zero frequency of the transfer function of the optical antenna driving system defined by the gain of the encoder, inertia of the optical antenna, gain of the motor driving amplifier, and parameters of the motor by receiving the input to the second integral element out of integral element of the reference model from the nearest integral element to the subtracter, and a second adder for adding the output of the nominal compensator, output of the robust compensator, and output of the feedforward element, whereupon the second adder transmits the output to the motor driving amplifier.

DETAILED DESCRIPTION OF THE PREFERRED EMBODIMENT

Figure 1:
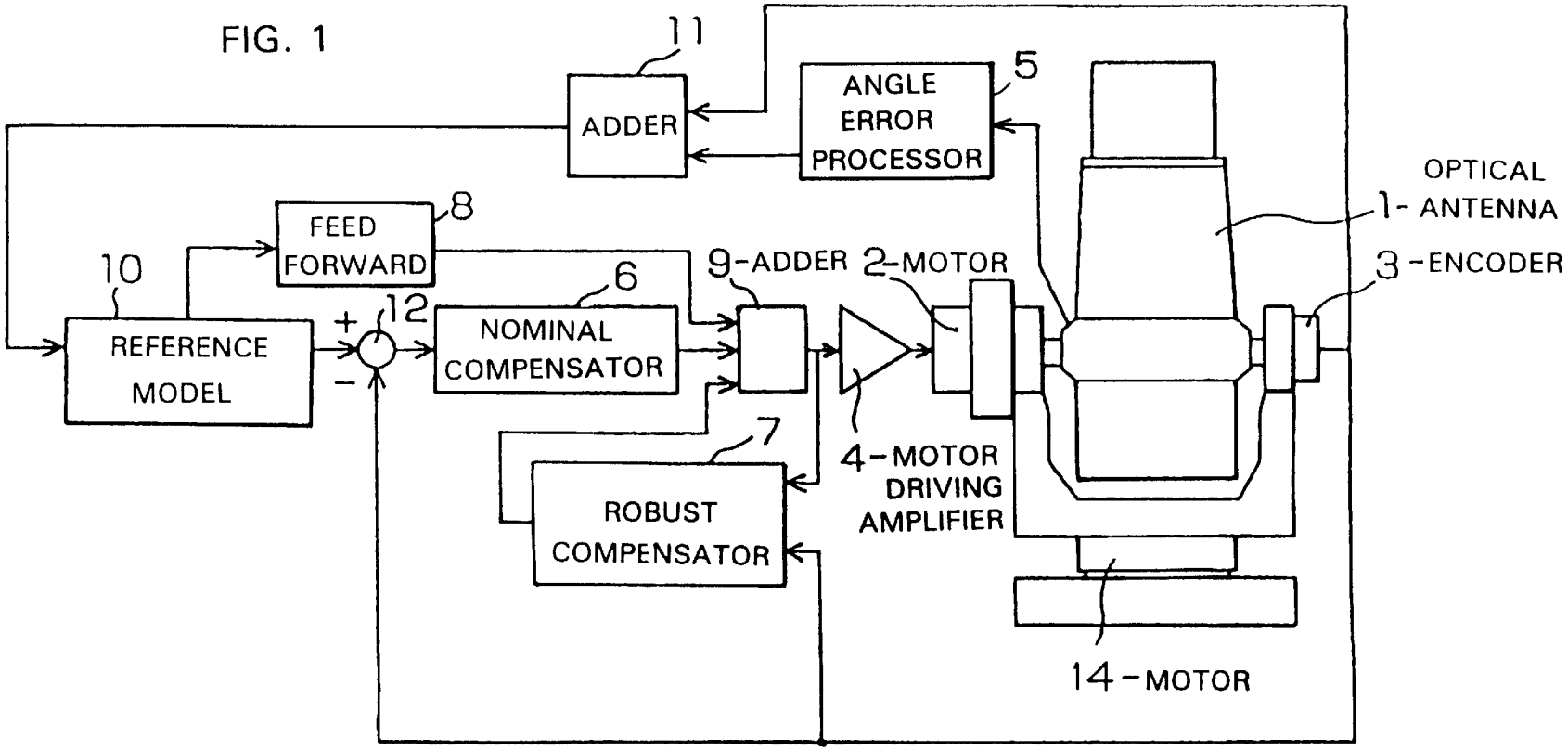
FIG. 1 is a conceptual block diagram for illustrating one structure of the present invention.

FIG. 1 is a conceptual diagram for illustrating one embodiment in accordance with the present invention.

In FIG. 1, an optical antenna having a biaxial gimbal structure in which the elevation axis is driven by a motor 2 and the azimuth axis is driven by a motor 14 is shown, but only a control system around the elevation axis is shown in the embodiment. A similar control system is provided to the azimuth axis.

Figure 4:
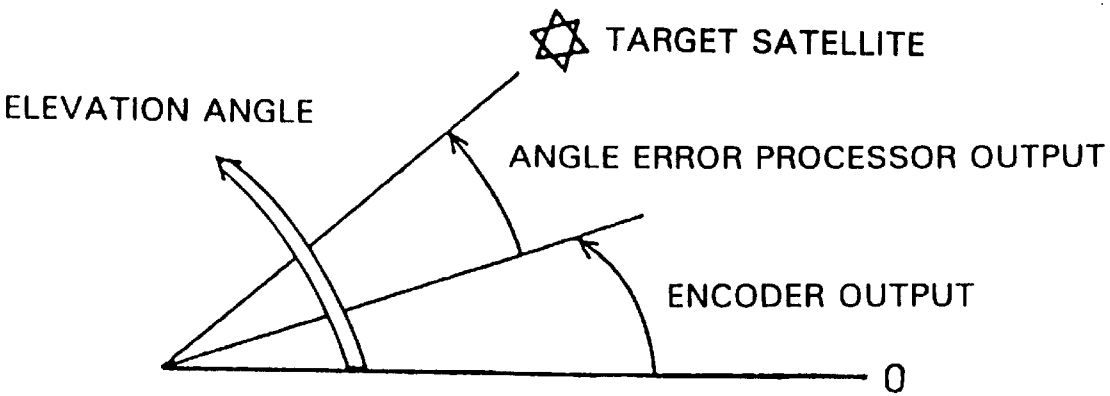
FIG. 4 is a diagram for describing the relationship between the output of an encoder and angle error processor of the present invention.

The optical antenna 1 is rotated around the elevation axis with aid of the motor 2 and a motor driving amplifier 4. The rotation angle of the optical antenna 1 around the elevation axis is detected by the encoder 3. The angle deviation between an output from the encoder 3, which is the pointing angle of the optical antenna, and a target satellite (not shown in the figure) to be captured by the optical antenna is processed by processing the optical beam (not shown in the figure) emitted from the target satellite using an angle deviation processor 5, upon which the angle deviation processor 5 outputs the result. The output of the encoder and output of the angle error processor 5 are inputted to an adder 11 to calculate the target pointing angle of the optical antenna toward the target satellite. FIG. 4 describes the relationship between an output value of the angle error processor 5 and an output value of the encoder 3. As shown in FIG. 4, the target pointing angle of the optical antenna 1 to the target satellite is given by the sum of an output of the encoder 3 and an output of the angle error processor 5.

An o t of the encoder 3 and an output of a reference model 10 are inputted to a subtracter 12, the difference between the output of the encoder and the output of the reference model 10 is calculated, and the subtracter 12 outputs the resultant difference to a nominal compensator 6. The output of the nominal compensator 6 is inputted to the motor driving amplifier 4 through an adder 9 to form a feedback control loop. A PI controller, PD controller, PID controller, or lead lag compensator is used as the nominal compensator 6, the nominal compensator 6 determines parameters so as to keep the feedback control system (which additionally includes the motor 2, optical antenna 1, and encoder 3) in sufficient gain stability. For example, the parameters are determined so that the gain peak of mechanical vibration is kept below −20 dB. The control band dependent on the nominal compensator 6 of the feedback loop is insufficient to capture quickly a target satellite for inter-satellite communication; therefore, a feedforward input is inputted to the adder 9 from a feedforward 8 as a control input for the optical antenna. The feedforward input is prepared by the reference model 10.

Figure 2:
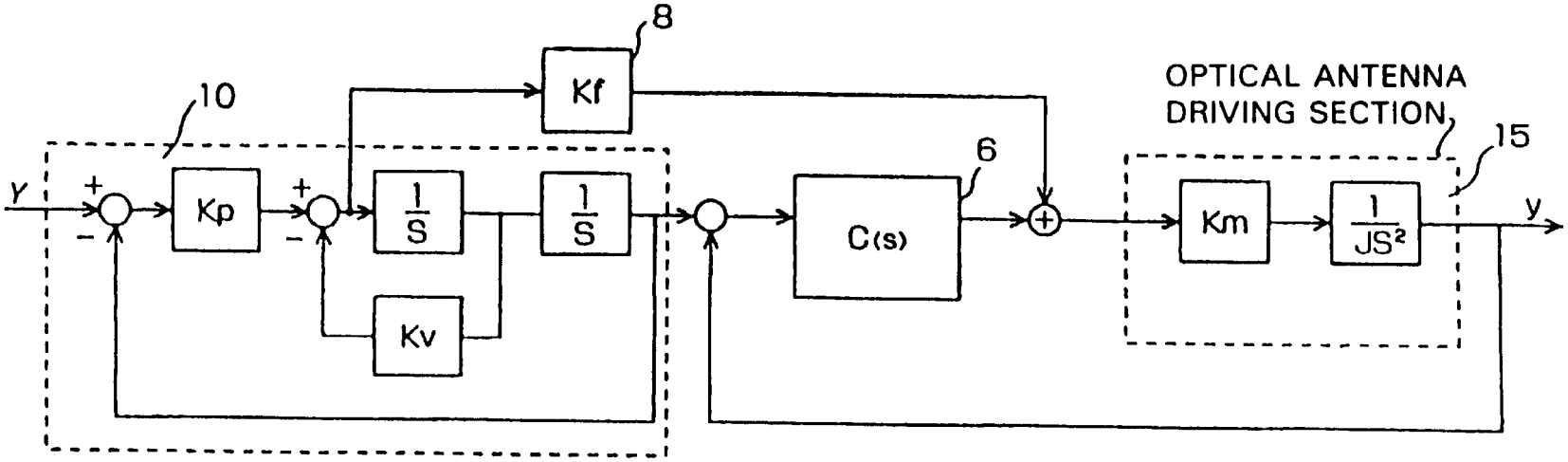
FIG. 2 is a block diagram for illustrating one structural example of a reference model and feedforward shown in FIG. 1.

FIG. 2 is a block diagram for illustrating one structural example of the reference model 10 and feedforward 8. In FIG. 2, a portion of the optical antenna driving section 15 enclosed with a rough dotted line includes the inertia of the optical antenna 1. C(s) represents the transfer function of the nominal compensator 6. The model of the driving section 15 including the optical antenna 1 and the driving motor 2, and motor driving amplifier 4 gain and encoder 3 gain is given by $Km/(J\cdot S^2)$, wherein s is the Laplace transformation operator. The reference model 10 shown in FIG. 2 is given as a second-order transfer function described as follows.

$$Kp/(s^2+Kv\cdot s+Kp) \tag{1}$$

Wherein, Kv and Kp are parameters which are prescribed arbitrarily.

When a transfer function Wry (s) from the target value 5 to the rotation angle y of the encoder 3 mounted on the optical antenna 1 is represented by the equation (3), below feedforward term 8 Kf is determined according to equation (2).

$$Kf=J/Km \tag{2}$$

$$Wry(s)=Kp/(s^2+Kv\cdot s+Kp) \tag{3}$$

The transfer function Wry(s) falls in the same form of the transfer function of the reference model 10, therefore the transfer function does not depend on the nominal compensator 6 of the feedback system. Therefore, by determining Kv and Kp so as to have sufficient response characteristics to capture a target satellite, the response characteristics for capturing a target satellite can be prescribed independently from the control band of the feedback control system.

The robust compensator 7 shown in FIG. 1 is a controller provided to reduce the influence of environmental changes on the optical antenna 1 and of friction at the gimbal of the optical antenna 1, and other disturbance torque. The output from the robust compensator 7 is also inputted to the adder 9 as a control input for the optical antenna 1 like the output from the feedforward 8.

Figure 3:
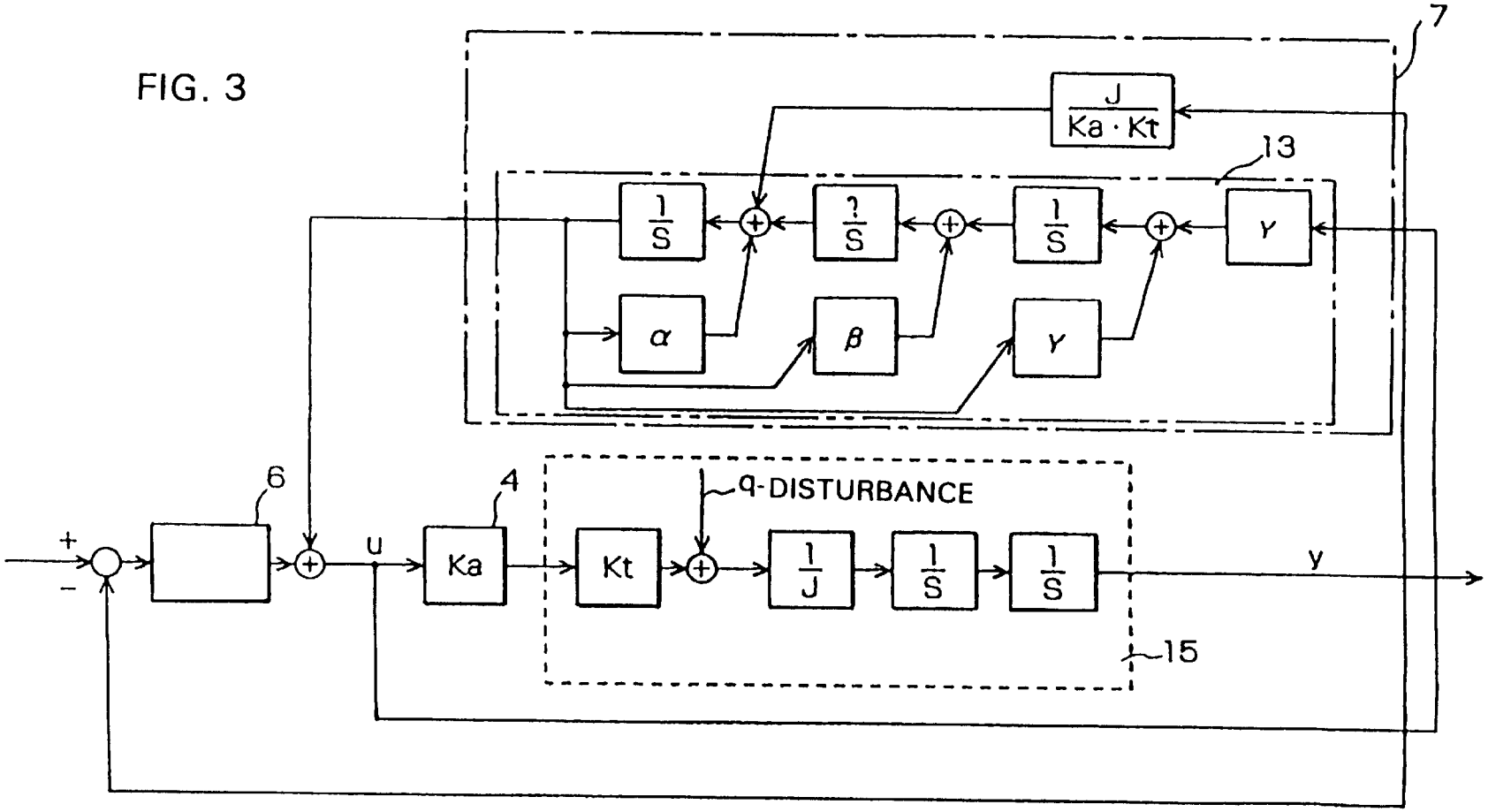
FIG. 3 is a block diagram for illustrating one structural example of a robust compensator.

FIG. 3 is a block diagram for illustrating one structural example of the robust compensator 7. In FIG. 3, the portion of the optical antenna driving section 15 enclosed with a rough dotted line includes the inertia of the optical antenna like as shown in FIG. 2. The model of the driving section 15 including the optical antenna 1, driving motor 2, and encoder 3 gain is given by $Kt/(J\cdot s^2)$ Herein for simplification, the gain of the encoder is assumed to be 1, and Kt is a torque constant of the motor 2. Ka represents the gain of the motor driving amplifier 4. In FIG. 3, q represents a disturbance torque, and u represents an input to the motor driving amplifier 4. y represents the rotation angle of the encoder 3. The numeral 6 represents the nominal compensator as described herein above. Herein, the disturbance q is represented by the equation (4) as follows.

$$q=J\cdot s^2\cdot y-Kt\cdot Ka\cdot u \tag{4}$$

Therefore, by applying the disturbance compensation value −q/(Kt·Ka) shown in the equation (5) below as an input to the motor driving amplifier 4, the influence of the disturbance q is completely eliminated.

$$-q/(Kt\cdot Ka)=-(J\cdot s^2)\cdot y/(Kt\cdot Ka)+u \tag{5}$$

However, as it is understandable from the equation (5), the equation (5) includes second-order differential elements The positive feedback of u itself to u results in the requirement for infinite gain. As such these problems are solved using a third-order low-pass filter 13 as shown in FIG. 3. As is obvious in FIG. 3, the gain of the low-pass filter 13 at zero frequency is 1, and the structure of such involves observable standard. Therefore, the quadratic differential element in the equation (5) is incorporated into the input of the third integral element of the low-pass filter 13 to eliminate the requirement for a pure differential element. The parameters α, β, and γ of the third-order low-pass filter is determined so that the Ho (H is infinite) norm of the feedback control system including the robust compensator shown in FIG. 3 is minimized. A method for obtaining parameters which minimize $H^{\infty}$(H is infinite) norm to the minimum such as singular value analysis may be used. By selecting the parameters which minimize $H^{\infty}$(H is infinite) norm, the stable margin of the control system is maintained consistently, and the influence of disturbance is significantly reduced by the effect of the robust compensator.

The feedback control system is gain-stabilized by the nominal control system 6, and as for disturbance, the disturbance is suppressed by the robust compensator 7, and the target satellite is captured quickly with aid of the reference model 10 and feedforward 8, thus the control system which does not depend on the band of the feedback control system is formed. The target pointing angle to the target satellite is given by the adder 11 as the input to the reference model 10, therefore in the control system of the present invention, the optical antenna 1 is driven to the target pointing angle depending on the response performance defined by the reference model 10. In the description of the embodiment, solely the control involving the elevation axis is described, however, the same control system is applied to the azimuth axis, and thus two freedom control system of the optical antenna 1 is realized. As described hereinbefore, the feedback control system is gain-stabilized by the nominal control system 6, the disturbance is suppressed by the robust compensator 7, and the target satellite is further captured quickly with aid of the reference model 10 and feedforward 8. Thus, a control system which does not depend on the band width of the feedback control system is structured.

What is claimed is:

1. An antenna pointing controller for an antenna driving system having an antenna, a biaxial gimbal mechanism coupled to said antenna, a motor for driving said antenna, a motor driving amplifier for feeding a current to said motor, an encoder for measuring a rotation angle of said antenna driven by said motor, and an angle error processor for generating an output of a pointing angle error of said antenna from a beam received by said antenna, said antenna pointing controller comprising:

a first adder for calculating a pointing angle target value for said antenna using an output of said encoder and the output of said angle error processor;

a reference model having at least a first and a second integral elements for receiving an output from said first adder to control the motion of said antenna;

a subtracter for calculating the difference between the output of said encoder and an output of said reference, model;

a nominal compensator for stabilizing a feedback control system of said optical antenna pointing controller which includes said antenna, said subtracter and said encoder, in response to an output from said subtracter;

a robust compensator for compensating for external forces and disturbances loaded on said antenna by receiving the output of said encoder and an output of said motor driving amplifier;

a feedforward element for reciprocally multiplying a gain in the zero frequency of the transfer function of the antenna driving system defined by a gain of said encoder, an inertia of said antenna, a gain of said motor driving amplifier, and parameters of said motor; and a second adder for adding an output of said nominal compensator, an output of said robust compensator and an output of said feedforward element, to provide an output to said motor driving amplifier.

2. An antenna pointing controller as claimed in claim 1, wherein said robust compensator includes a third-order low-pass filter having a plurality of parameters, and a second-order differential element having a gain, wherein the parameters of said third-order low-pass filter are defined so that the $H\infty$norm of the feedback control system is brought to its minimum, and wherein the gain of the second-order differential element of said robust compensator defines the reciprocal number of the gain at zero frequency of the transfer function of the antenna driving system defined by the gain of said encoder, the inertia of said antenna, the gain of said motor driving amplifier, and the parameters of said motor.

3. An antenna pointing controller as claimed in claim 2, wherein said integral elements of said reference model are connected in series, and wherein a gain at zero frequency of the transfer function of said reference model is 1.

4. An antenna pointing controller as claimed in claim 1, wherein said robust compensator includes a low-pass filter with a gain of 1 at zero frequency in a second-order or higher transfer function, and a second-order differential elements having a gain.

5. An antenna pointing controller as claimed in claim 1, wherein said feedforward element receives an input which is also supplied to said integral element in said reference model.

6. An antenna pointing controller as claimed in claim 1, wherein said encoder is mounted on an end of said antenna opposite to an end where said motor is mounted.

7. An optical antenna pointing controller for an optical antenna driving mechanism having an optical antenna for optical communication coupled to a biaxial gimbal mechanism mounted on a satellite, a motor for driving said optical antenna, a motor driving amplifier for feeding a current to said motor, an encoder for measuring a rotation angle of said optical antenna driven by said motor, said encoder being mounted on an end of said optical antenna opposite to an end where said motor is mounted, and an angle error processor for generating an output representing a pointing angle error of said optical antenna from an optical beam received by said optical antenna, said optical antenna pointing controller comprising:

a first adder for calculating a pointing angle target value for said optical antenna using an output of said encoder and the output of said angle error processor as input;

a reference model having at least a first and a second integral elements for receiving an output from said first adder to control the motion of said optical antenna;

a subtracter for calculating the difference between the output of said encoder and an output of said reference model;

a nominal compensator for stabilizing a feedback control system of said optical antenna pointing controller which includes said optical antenna, said subtracter, and said encoder, said nominal compensator performing said stabilizing by receiving an-output from said subtracter;

a robust compensator having a low-pass filter with a gain of 1 at-zero frequency in a second-order or higher transfer function, and a second-order differential element having a gain for compensating for external forces and disturbances loaded on said optical antenna by receiving the output of said encoder and an output of said motor driving amplifier;

a feedforward element for reciprocally multiplying a gain at the zero frequency of the transfer function of the optical antenna driving system defined by a gain of said encoder, an inertia of said optical antenna, a gain of said motor driving amplifier, and parameters of said motor, said feedforward element performing said multiplying by receiving an input which is also supplied to the second integral element of said referance model; and a second adder for adding an output of said nominal compensator, an output of said robust compensator, and an output of said feedforward element, whereupon said second adder then outputs an output therefrom to said motor driving amplifier.

8. The optical antenna pointing controller as claimed in claim 7, wherein said low-pass filter of said robust compensator is a third-order low-pass filter having a plurality of parameters which are defined so that the $H\infty$norm of the feedback control system is brought to its minimum, and wherein the gain of the second-order differential element of said robust compensator defines the reciprocal number of the gain at zero frequency of the transfer function of the optical antenna driving system defined by the gain of said encoder, the inertia of said optical antenna, the gain of said motor driving amplifier, and the parameters of said motor.

9. The optical antenna pointing controller at claimed in claim 8, wherein said integral elements of said reference model are connected in series, and wherein a gain at zero frequency of the transfer function of said reference model is 1.

10. An antenna driving mechanism comprising:

an optical antenna;

a biaxial gimbal mechanism connected to said antenna;

a motor for driving said optical antenna;

a motor driving amplifier for feeding a current to said motor;

encoder for measuring a rotation angle of said optical antenna driven by said motor;

an angle error processor for generating an output representing a pointing angle error of said optical antenna from an optical beam received by said optical antenna;

a first adder for calculating a pointing angle target value for said optical antenna using an output of said encoder and the output of said angle error processor as input;

a reference model having at least a first and a second integral elements for receiving an output from said first adder to control the motion of said optical antenna;

a subtracter for calculating the difference between the output of said encoder and an output of said reference model;

a nominal compensator for stabilizing a feedback control system of said optical antenna pointing controller which includes said optical antenna, said subtracter, and said encoder, said nominal compensator performing said stabilizing by receiving an output from said subtracter;

a robust compensator including a low-pass filter with a gain of 1 at zero frequency in a second-order or higher transfer function, a second-order differential element and a gain, for compensating for external forces and disturbance disturbances loaded on said optical antenna by receiving the output of said encoder and an output of said motor driving amplifier;

a feedforward element for reciprocally multiplying a gain at the zero frequency of the transfer function of the optical antenna driving system defined by a gain of said encoder, an inertia of said optical antenna, a gain of said motor driving amplifier, and parameters of said motor, said feedforward element performing said multiplying by receiving an input which is also supplied to the second integral element said reference model; and a second adder for adding an output of said nominal compensator, an output of said robust compensator and an output of said feedforward element, said second adder outputting an output to said motor driving amplifier.

* * * * *